US011498114B2

(12) United States Patent
Ruh

(10) Patent No.: US 11,498,114 B2
(45) Date of Patent: Nov. 15, 2022

(54) THIN-WALLED HOLLOW WHEELS WITH INTERNAL AND EXTERNAL TOOTHING, AND APPARATUS AND METHOD FOR MANUFACTURING THE SAME

(71) Applicant: Ernst Grob AG, Männedorf (CH)

(72) Inventor: Fabian Ruh, Wald (CH)

(73) Assignee: ERNST GROB AG, Männedorf (CH)

( * ) Notice: Subject to any disclaimer, the term of this patent is extended or adjusted under 35 U.S.C. 154(b) by 2 days.

(21) Appl. No.: 16/969,585

(22) PCT Filed: Feb. 14, 2019

(86) PCT No.: PCT/EP2019/053712
§ 371 (c)(1),
(2) Date: Aug. 13, 2020

(87) PCT Pub. No.: WO2019/158656
PCT Pub. Date: Aug. 22, 2019

(65) Prior Publication Data

US 2021/0054917 A1 Feb. 25, 2021

(30) Foreign Application Priority Data

Feb. 16, 2018 (CH) ..... 00193/18

(51) Int. Cl.
*B21D 53/28* (2006.01)
*B21K 1/30* (2006.01)

(52) U.S. Cl.
CPC ..... *B21D 53/28* (2013.01); *B21K 1/30* (2013.01); *Y10T 29/49462* (2015.01)

(58) Field of Classification Search
CPC ..... B21D 53/28; B21D 22/025; B21K 1/30; Y10T 29/49462; B21H 5/025; B21H 5/02
See application file for complete search history.

(56) References Cited

U.S. PATENT DOCUMENTS 7,191,626 B2 * 3/2007 Tittmann ..... B21H 5/025 72/85
8,117,884 B2 * 2/2012 Deriaz ..... B21D 53/28 72/74

(Continued)

FOREIGN PATENT DOCUMENTS

CH 670 970 7/1989
CH 675840 11/1990

(Continued)

OTHER PUBLICATIONS

English translation of Taiwan Office Action dated May 24, 2022, Application No. 108104765, 7 pages.

*Primary Examiner* — Ryan J. Walters
(74) *Attorney, Agent, or Firm* — Rankin, Hill & Clark LLP

(57) ABSTRACT

In a method for manufacturing a hollow wheel which includes an internal toothing and an external toothing, wherein the internal toothing is a gear toothing, a workpiece is machined by way of a stamping tool. The workpiece has a tubular section with a longitudinal axis and a first stabilisation section for the shape stabilisation of the tubular section during the machining. The tubular section is inserted into a die having an internal die toothing. The workpiece is machined on the inner side by the stamping tool so as to simultaneously produce internal and external toothing by way of the workpiece executing a rotation movement with a temporally varying rotation speed and the stamping tool executing radially oscillating movements that are synchronised with the rotation movement.

18 Claims, 4 Drawing Sheets

(56) References Cited

U.S. PATENT DOCUMENTS

| | | | | |
|---|---|---|---|---|
| 8,375,761 | B2 * | 2/2013 | Wittig | B21D 17/04 72/213 |
| 9,174,291 | B2 * | 11/2015 | Ruh | B23F 1/00 |
| 10,072,718 | B2 * | 9/2018 | Deriaz | F16D 65/123 |
| 10,675,673 | B2 * | 6/2020 | Yamagata | F16H 55/17 |
| 2017/0348763 | A1 * | 12/2017 | Yamagata | B23P 15/14 |
| 2018/0036791 | A1 * | 2/2018 | Simon | B21D 53/28 |

FOREIGN PATENT DOCUMENTS

| | | |
|---|---|---|
| CH | 685542 | 8/1995 |
| CN | 102500690 | 6/2012 |
| CN | 102781603 | 11/2015 |
| DE | 25 49 230 | 9/1976 |
| DE | 37 15 393 | 1/1996 |
| DE | 10 2008 017 608 | 4/2009 |
| EP | 0 688 617 | 7/1997 |
| EP | 3 248 708 | 11/2017 |
| JP | 8-174125 | 7/1996 |
| JP | 2001-58236 | 3/2001 |
| TW | 544351 | 8/2003 |
| WO | 2007/009267 | 1/2007 |
| WO | 2013/159241 | 10/2013 |

* cited by examiner

THIN-WALLED HOLLOW WHEELS WITH INTERNAL AND EXTERNAL TOOTHING, AND APPARATUS AND METHOD FOR MANUFACTURING THE SAME

BACKGROUND OF THE INVENTION

Field of the Invention

The invention relates to the field of manufacture of gear toothings in hollow wheels and more precisely to corresponding internal toothings. Gear toothings and in particular involute toothings are applied in toothed gearings and in particular in planetary gears, for example in those of automatic transmissions for automobiles, but also in other fields of vehicle construction and engineering.

Description of Related Art

Internal gear toothings nowadays are produced above all by material-removing methods, in particular by broaching.

Broaching is also applied for producing toothed hub profiles such as internal toothings according to DIN 5480, DIN 5482, etc.

If workpieces with a gear toothing and which are designed in a pot-like manner are to be created by way of broaching, then the gear toothing must firstly be created in a part which corresponds to the pot wall and this part subsequently connected to the pot base part, for example by way of laser welding or electron beam welding.

If a gear toothing is to be produced in a material-removing manner in a workpiece that is designed in a pot-like manner, then planing is applied, which however has a reduced economic efficiency compared to broaching.

The manufacture of internally toothed hollow wheels by way of sintering is an alternative in the case of parts that are mechanically loaded to a lesser degree, wherein this moreover allows hollow wheels that are designed in a pot-like manner to be integrally formed (and thus to form a unitary part) without a subsequent connecting step for the pot base and the wall having to be carried out.

An alternative method for manufacturing internal gear toothings, the alternative method being based on cold reshaping (cold forming) and is known from WO 2013/159 241 A1. There, it is described how an internal gear toothing can be produced in the workpiece by way of the radially hammering machining of a thick-walled workpiece from the inside by way of a stamping tool.

It would appear that exclusively thick-walled hollow wheels are known from the state of the art. A high shape-stability of the hollow wheel is achieved by way of this, if it is applied for example in a planetary gear. However, a relatively high weight of the hollow wheel also results from this. At the outside, such a hollow wheel in its internally toothed region usually retains the shape that it already had as an untoothed blank, so that given cylinder-toothed hollow wheels which are manufactured starting from corresponding cylinder-tube-shaped blanks, the hollow wheel that is provided with the internal toothing at the outside mostly also has a cylinder shell. Its diameter is larger than the root diameter of the internal toothing by twice the residual wall thickness of the internal toothing. The residual wall thickness of such a thick-walled hollow wheel is at least 0.25 times as large or as a rule rather at least 0.5 times as large as the toothing depth of the internal toothing.

Despite the general requirement for lightweight construction components that has existed for decades, the idea of designing a gear-toothed hollow wheel as a lightweight construction part does not seem to have entered consciousness or at least does not seem to have been realised, above all also in vehicle manufacture. Of course, the weight of a hollow wheel can be reduced if very low residual wall thicknesses are selected, for example as in the case of the previously mentioned residual wall thickness in the range of between 0.25 times and 0.5 times the toothing depth. However, lower limits are placed upon the residual wall thickness due to manufacturing suitability and also due to the shape stability which is necessary on application.

Further cold reshaping (cold forming) manufacturing methods are known from another technical field, specifically the manufacture of spline toothings. For example, spline toothings, (also called splines) can be created by cold reshaping by way of an externally profile mandrel being inserted into a hollow-cylindrical workpiece and an inner profiling of the workpiece that corresponds to the profiling of the mandrel then being produced by way of the workpiece being machined from the outside by way of impact rolling by way of unprofiled tools that are driven in an planetary manner and periodically act upon the workpiece. Such methods are known, for example, from DE 37 15 393 C2, CH 670 970 A5, CH 675 840 A5, CH 685 542 A5 and EP 0 688 617 B1.

A manufacture of internal gear toothings by way of cold reshaping, however, is very difficult to realise since gear toothings have significantly larger tooth heights, at least compared to spline toothings and moreover generally place greater precision demands on the tooth shape.

A method for manufacturing an inner profiling and outer profiling in thin-walled cylindrical hollow parts is described in WO 2007/009267 A1. The thin-walled hollow part is seated on an externally profiled mandrel and is machined in a cold reshaping manner by way of at least one profiling tool that strikingly acts upon the hollow part from the outside. Herein, the profiling tool is moved perpendicularly to the surface, thus radially and the hollow part is axially displaced at a constant radial feed depth with respect to the profiling tool. The profiling that is defined by the mandrel is transferred onto the internal toothing of the thin-walled hollow part by way of this method, and a shape that is defined by the profiling tool can be transferred onto the external toothing of the thin-walled hollow part. The method is very suitable for the manufacture of spline toothings, but is completely unsuitable for the creation of an internal gear toothing since it can only be used with thin-walled sheet-metal parts, by which means neither can a manufacturing accuracy which is adequate for gear toothings nor an adequate loadability on application be achieved.

SUMMARY OF THE INVENTION

It is the object of the invention to create an alternative method, by way of which an internal (inner-lying) gear toothing can be produced. Furthermore, a corresponding hollow wheel and an apparatus for producing corresponding hollow wheels are to be created. Entailed by this, a use of the apparatus and a planetary gear as well as a method for manufacturing a planetary gear and a hollow wheel component are to be provided.

In particular, it is an object of the invention to provide methods and apparatuses which do not have the disadvantages of the methods and apparatuses of the state of the art.

The inventor has recognised that efforts with regard to lightweight construction can also concern hollow wheels which are provided with an internal toothing, this being a gear toothing. Furthermore, he has also developed a possibility of manufacturing such hollow wheels economically, but despite this with a high precision.

Furthermore, new components and applications that cannot be carried out with hollow wheels that are known from the state of the art or only with a relatively high effort and are therefore probably not able to be implemented or manufactured economically, result from the inventive idea.

One aspect of the invention is that the hollow wheel not only includes an internal toothing, which is a gear toothing, but yet also an external toothing. On account of this, on the one hand not only can a residual wall thickness (which indeed is measured in the region of a tooth root of the internal toothing), which is adequate for the planned application of the hollow wheel be provided, but on the other hand a material thickness of the hollow wheel that is significantly lower than would be the case if the hollow wheel at the outside were to describe the shape of an (untoothed) cylinder shell (cylinder lateral surface) can also be provided in the region of the tooth tips of the internal toothing. There, in the region of the tooth tips of the internal toothing, the hollow wheel therefore has a significantly reduced material thickness compared to the unprofiled hollow wheels that are internally gear-toothed and rotationally symmetrical at the outside and are known from the state of the art, so that the weight of the hollow wheel is significantly reduced. And yet despite this, a shape stability that is sufficient for the planned application can still be achieved.

Furthermore, the external toothing can be utilised, for example, in order to therewith connect a further body to the hollow wheel in a rotationally fixed manner.

Hollow wheels that include an internal toothing (as a gear toothing) as well as an external toothing could be manufactured by way of the aforementioned, known sintering methods. In this case too, the hollow wheel can have a relatively low mass. However, these may not be suited to applications, in which the hollow wheel is subjected to greater mechanical loads.

Furthermore, it can be assumed that a manufacture of an internally and externally toothed hollow wheel by way of material-removing methods is less economical, since not only does the internal gear toothing need to be created in a material-removing manner, but additionally also the external toothing, which first and foremost is tantamount to double the manufacturing effort.

The cold reshaping method, which is known from WO 2013/159 241 A1, also gives no hint as to being developed further to arrive at the present invention.

A further aspect of the invention that chiefly relates to the manufacturing method and the apparatus for manufacture is that it requires a stabilisation of the workpiece during the manufacturing process for achieving an adequately high precision as is necessary for gear toothings. If one acts upon a workpiece in a hammering, cold-reshaping manner with the method which is described herein, then this can lead to undesirable deformations, for example to deviations from the cylinder symmetry, which in turn can lead to flank shapes of the gear toothing that are not formed in an adequately precise manner.

Accordingly, at least one stabilisation section that counteracts such problems can be provided.

Yet a further aspect of the invention that chiefly relates to the manufacturing method and to the apparatus for the manufacture is that a die that includes an internal die toothing is used, so that a workpiece that is to be reshaped into the hollow wheel is reshaped in a manner such that a gear toothing as an internal toothing and a further toothing as an external toothing simultaneously arise. By way of a hammering machining of the workpiece from the inside by way of a stamping tool, a tooth gap of the internal toothing is produced where the stamping tool (with its projecting active region) engages and a tooth of the external toothing is simultaneously produced there (thus at the same peripheral position), specifically by way of the material of the workpiece being driven into a tooth gap of the die toothing by way of the stamping tool. In contrast, a radially outwardly directed flow of material is prevented by way of the adjacent tooth tips of the die toothing, so that the tooth roots of the external toothing can form there.

The stamping tool can include calibrating regions for a well defined formation of the tooth tips of the internal toothing, the calibrating regions simultaneously limiting a material flow radially inwards, so that a tooth tip that forms next to a tooth gap of the internal toothing does not project too far radially inwards.

The peripheral positions of the teeth of the internal toothing and of the tooth gaps of the external toothing are equal. And the peripheral positions of the tooth gaps of the internal toothing and of the teeth of the external toothing are likewise the same.

Typically, the internal toothing (designed as a gear toothing) has a greater toothing depth than the external toothing. The toothing depth of a toothing is defined as half the difference between the tip diameter and the root diameter of the toothing. It therefore also results as a sum of the addendum and dedendum of the toothing.

An object of the invention is the provision of a new type of hollow wheel.

A further object of the invention is the provision of hollow wheels with a particularly low weight.

A further object of the invention is to be able to manufacture or provide hollow wheels that have an internal gear toothing of a high quality.

A further object of the invention is to provide a very economical manufacturing manner for hollow wheels with an internal gear toothing and in particular to achieve short machining times.

A further object of the invention is to provide a possibility of producing internal gear toothings with large toothing depths. Gear toothings with slim teeth should be able to be produced in hollow wheels.

A further object of the invention is to provide a possibility of producing internal gear toothings in hollow wheels that are designed in a pot-like manner, in particular whilst ensuring a precise alignment of the pot base with respect to the toothing.

A further object of the invention is to provide a possibility of producing internal helical toothings of gears.

A further object of the invention is to provide a possibility of producing internal herringbone toothings of gears.

A further object of the invention is to provide new types of hollow wheel components which include an internally toothed and externally toothed hollow wheel.

A further object of the invention is to provide new types of gears, in particular new types of planetary gears.

The method can be for example: a method for manufacturing a hollow wheel that includes an internal toothing and an external toothing, wherein the internal toothing is a gear toothing, and wherein a workpiece is machined by way of at least one stamping tool.

The workpiece can include a tubular section with a longitudinal axis. This can have a round (circular) cross section. Accordingly, the tubular section can have a cylinder symmetry and in particular be cylinder-tube-shaped The workpiece can additionally yet include at least one first stabilisation section that is connected to the tubular section. This can serve for a shape stabilisation of the tubular section during the machining by way of the at least one stamping tool. For example, deformations that would result in an oval cross section from a circular cross section of the tubular section can be prevented. The first stabilisation section can be connected to the tubular section in a direct manner, thus directly connect onto this. However, the tubular section can also be indirectly connected to the tubular section, specifically via a transition region.

Furthermore, a die that includes a tubular opening, in which an internal die toothing is formed, can be provided. The tubular opening can be provided for receiving the tubular section. It can include the same number of teeth as the toothings that are to be produced, thus as the internal toothing and the external toothing.

The tubular section can be inserted into the tubular opening, and the workpiece is subsequently machined on the inner side of the tubular section by way of the at least one stamping tool, this specifically being such that the internal toothing and the external toothing are produced simultaneously.

For this, the workpiece executes a rotation movement about the longitudinal axis with a temporally varying rotation speed, for example an intermittent rotation. In particular, the workpiece and the die can carry out said rotation movement (together). And the at least one stamping tool executes radially oscillating movements which are synchronised with the rotation movement. Herein, the term "radial" characterises alignments perpendicular to the longitudinal axis. The term "axial" characterises alignments parallel to the longitudinal axis.

The synchronisation is designed such that the at least one stamping tool forms the tubular section into the die toothing for producing the external toothing given a simultaneous production of the internal toothing by way of a repeated hammering machining of the tubular section.

One can therefore envisage—in each case at the point of time of a hammering engagement of the at least one stamping tool into the workpiece—the die having such a rotational alignment that a tooth gap of the die toothing is present at the peripheral position, at which the engagement of the stamping tool takes place. This can be provided for each tooth gap of the die toothing, and specifically in particular such that the stamping tool machines the tubular section several times in the described manner at each of the described peripheral positions.

The method permits gear toothings of the quality 8 or 7 or under certain circumstances also 6 according to DIN 3961/DIN 3962 to be produced, this being the case in a very economical manner since very short machining times are rendered possible.

Furthermore, one can start from a relatively inexpensive material since the material characteristics are improved by way of the described cold reshaping. For example, the material can obtain a greater strength.

The stamping tool can repeatedly machine the tubular section at those peripheral positions, at which the internal die toothing includes tooth gaps. By way of this, the tubular second can be successively formed into the internal die toothing. Teeth of the external toothing and tooth gaps of the internal toothing can therefore be formed at the peripheral positions (where the internal die toothing includes tooth gaps). Tooth gaps of the external toothing and teeth of the internal toothing can be formed simultaneously, and specifically at the peripheral positions which lie therebetween and at which the internal die toothing includes teeth.

The temporally varying rotation speed of the workpiece forms consecutive phases of a relatively high rotation speed and relatively low rotation speed, wherein in particular one can envisage the workpiece at least momentarily coming to a (rotation) standstill (rotation standstill also has a rotation speed, specifically zero) in the phases of the relatively low rotation speed. The machining of the workpiece by a stamping tool usually takes place in each case during one of the phases of a relatively low rotation speed. The slower the workpiece rotates during the engagement of the respective stamping tool or the longer the workpiece rotates slowly in the phases of relatively low rotation speed or is at a standstill, the easier it is to achieve a high precision of the finally produced gear toothing.

For example, the stamping tool can machine the workpiece in those phases of the rotation movement, in which the workpiece is at least momentarily at a standstill. In particular, the rotation movement of the workpiece can be an intermittent rotation, and the stamping tool machines the workpiece in phases of the rotation standstill of the workpiece. The stamping tool is therefore then engaged with the workpiece in phases of the standstill of the intermittent workpiece rotation movement. It should be noted that an intermittent rotation includes phases of the rotation standstill being provided between phases of the rotation, wherein phases characterise time durations, by which means the standstill phases differ from the momentary standstill. One then normally envisages the workpiece being reshaped within the times of the rotation standstill, and the stamping tool being so remote from the workpiece during the rotation of the workpiece (or all stamping tools being so remote from the workpiece), that the workpiece can rotate without coming into contact with the (or with a) stamping tool or even being prevented from rotating by the (or a) stamping tool.

The temporally varying rotation speed of the workpiece is usually a rotation speed which periodically varies at least in sections.

The rotation movement of the workpiece is co-carried out by the die. For example, the workpiece and the die are fixed to one another so that they execute the same rotation movement.

Herein, the workpiece and the die are at least essentially aligned coaxially to one another as well also (at least essentially) aligned coaxially to the longitudinal axis.

Material of the tubular section is reshaped by the machining by way of the at least one stamping tool and formed into the tooth gaps of the die toothing, such that at the outside it adapts its shape to the shape of the tooth tips and to the shape of sections of the tooth flanks of the die toothing, said sections being adjacent to the tooth tips. An external toothing therefore arises, with flank shapes that correspond to a negative of flank shapes (or of sections of flank shapes) of the die toothing and whose tooth root shape corresponds to a negative of the tooth tip shape of the die toothing.

The internal toothing is simultaneously formed, whose flank shapes correspond to a negative of flank shapes of the stamping tool and whose tooth root shape corresponds to a negative of a tool tip shape of the stamping tool.

The workpiece is machined in a hammering manner by the stamping tool. It can be periodically machined by way of the radially oscillating hammering movement of the stamping tool.

The internal and external toothing can be successively formed in this manner. The tooth gaps of the internal toothing become increasingly deeper with time (due to the increasing number of hammering engagements per tooth gap of the internal toothing), and the teeth of the external toothing simultaneously become increasingly taller.

The stamping tool serves for the periodic action upon the workpiece, so that the production of the toothings can be broken down into in a multitude of individual stamping procedures.

No material removal arises by way of the formation of the internal toothing and the external toothing by way of the at least one stamping tool. A chip removal does not therefore take place. The tubular section is merely cold reshaped by way of the stamping tool. A chip-removing post machining of one of the produced toothings as a rule is not necessary.

A cross-sectional area of the tubular section in a plane that is aligned perpendicularly to the longitudinal axis remains essentially unchanged on creating the toothings and it is therefore essentially the same before and after the incorporation of the toothings, at least within 2% or at least within 5%.

One can envisage the workpiece being hardened by way of the effect of heat after creating the toothings. On account of the cold reshaping machining by way of the stamping tool, a hardening distortion, to which a hollow wheel is subjected on hardening by way of heat action, is significantly lower than with a hollow wheel concerning which the gear toothing has been produced in a material-removing manner.

The workpiece is typically of metal, for example of a steel, for example of alloyed quenched and tempered steel (typically with at least 0.3% carbon content), which is subsequently typically inductively hardened or laser hardened, or of alloyed case-hardening steel (typically with at the most 0.3% carbon content), which is subsequently typically hardened by way of gas-nitriding or nitro-carburising.

The die is typically of metal.

In an embodiment, a material thickness of the workpiece in the tubular section is less than twice, in particular less than 1.5 times a toothing depth of the internal toothing, before inserting the tubular section into the tubular opening.

A formation of the external toothing no longer occurs given material thicknesses, which are too large.

In an embodiment, a material thickness of the workpiece in the tubular section is at least 0.2 times, in particular at least a quarter of a toothing depth of the internal toothing, before the insertion of the tubular section into the tubular opening.

In the case of material thicknesses that are too small, the material of the tubular section no longer has an adequate stability, in order to be reshaped into the desired (internally and externally toothed) shape.

In an embodiment, the at least one stamping tool includes an active region that includes a tool head and two tool flanks adjoining the tool head. The shape of the flanks of the internal toothing is defined by the tool flanks. The shape of the tooth roots of the internal toothing is defined by the tool head.

Accordingly, the active region can have a shape that is a negative of a shape of a tooth gap of the internal toothing or more precisely: a negative of a shape of a tooth root including the adjacent tooth flanks of the internal toothing.

Furthermore, the at least one stamping tool can include two calibrating regions adjoining one of the two tool flanks each. Their shape can each be a negative of a shape of a section of a tooth tip of the internal toothing.

By way of this, it is possible to also shape the tooth tips of the internal toothing in a defined manner. The material flow that results on account of the hammering machining can be suitably guided and limited by way of the calibrating regions.

The tooth tip shape of the internal toothing and also the respective region of the internal toothing, where a tooth tip of the internal toothing is adjacent to tooth flanks of the internal toothing, can be precisely defined by way of the calibrating regions.

In an embodiment, the internal toothing has a longitudinal crowing.

In an embodiment, the tool flanks are shaped in a manner such that the internal toothing has a longitudinal crowning.

Accordingly, the tool flanks can have a concavity. More precisely, this is a concavity relative to the shape of tool flanks that are designed for forming the same internal toothing without a longitudinal crowning.

For example, for the case that the internal toothing is a spur toothing, the stamping tool (and more precisely: the active region of the stamping tool) in a section that runs through the tool flanks and that runs perpendicularly to a plane running centrally between the two tool flanks has a concavity at both tool flanks. Both tool flanks each describe a concave line in the section. The stamping tool (and more precisely: the active region of the stamping tool) is waisted in this section.

Due to the concavity of the tool flanks, the produced internal toothing has a corresponding convexity: the longitudinal crowning.

The hollow wheels that are described here are thin-walled relative to the thick-walled hollow wheels (without a corresponding external toothing), which are known from the state of the art. On account of this, in the case of these hollow wheels, large mechanical loads would tend to lead to elastic deformations more so that would be the case with thick-walled hollow wheels of the same residual wall thickness, the longitudinal crowning can be provided for an improved running behaviour, for example for a smoother running. Edge supports can therefore be avoided and a well-defined contact of an externally toothed wheel that runs in the hollow wheel, for example essentially in the middle of the length that is toothed by the internal toothing, can be ensured.

The stamping tool in the running direction of the tool head (corresponding to the toothing direction, thus the running direction of the tooth gaps of the internal toothing) can be at least as long as, in particular even longer than, the tooth gaps of the gear toothing, This of course relates to the active region of the stamping tool, wherein the stamping tool indeed engages into the workpiece, thus comes into (reshaping) contact with this. This can contribute to ensuring that the gear toothing is created with a high precision over its entire length. Moreover, the method can be particularly economical. It can also simplify the production of the aforementioned longitudinal crowning of the internal toothing, in particular specifically by way of a stamping tool being used and coming into reshaping contact with the workpiece over the complete toothing length of the internal toothing with each of the hammering engagements, the workpiece having the described concavity of the tool flanks.

It is possible to carry out the method with the described machining steps such that additional steps for calibrating or post-shaping the gear toothing no longer need to be subsequently carried out.

In an embodiment, a formation of the internal toothing and external toothing that advances in the toothing direction is effected in a multitude of revolutions of the rotation of the workpiece by way of the (periodic) machining of the workpiece by way of the stamping tool, until a predefined toothed length is achieved. Typically, in this case the at least one stamping tool and the workpiece (during the rotation movement of the workpiece and during the radially oscillating stamping tool movement) are moved relative to one another in the axial direction.

The relative movement of the workpiece and stamping tool therefore describes, for example, a helical space curve superimposed by the radially oscillating movement of the stamping tool.

It is possible to carry out the method with a single stamping tool or also to use two stamping tools, independently of whether for example the reshaping of the workpiece takes place over the complete toothing length with each hammering engagement or whether, with each hammering engagement, the workpiece is only reshaped in a region that only extends along a fraction of the toothing length.

Either way, the tubular section is provided with the toothings, thus with the internal toothing and the external toothing.

In some embodiments, the region of the workpiece that is provided with the internal and external toothing is identical to the tubular section.

In some embodiments, the internal and external toothing merge into a residual toothings in a transition region adjoining the tubular section.

The already mentioned first stabilisation section can form a unitary part (and thus be integrally formed) together with the tubular section. For example, the workpiece whose tubular section is inserted into the tubular opening can be a deep-drawn sheet metal part, for example of steel sheet.

The first stabilisation section can also from a collar of the hollow wheel, in particular a collar that can form a unitary part together with the tubular section.

In particular, one can envisage the first stabilisation section (or the collar) neither including the internal toothing nor the external toothing.

The collar can be a non-toothed collar.

The collar can be directed towards the longitudinal axis or away from the longitudinal axis.

The first stabilisation section can therefore effect a stiffening of the workpiece. Undesirable deformations of the workpiece, in particular also in the region of the toothings can hence be drastically reduced, so that the reshaping by way of the at least one stamping tool can take place with a high precision. Moreover, a basically circular cross section of the tubular section can be retained during the reshaping and also in the finished hollow wheel.

The shape stabilisation by way of the first stabilisation section permits the minimisation of deformations in the radial direction, such being non-uniform over the periphery. For example, undesirable deformations of the tubular section into an oval can be prevented or at least greatly reduced.

Furthermore, in particular the provision of two stabilisation sections, for example at opposite ends of the tubular section can prevent or greatly reduce deformations of the tubular section that possibly otherwise occur and could lead to a conicity of the tubular section, thus, for example, to a change of the diameter of the tubular section along a direction parallel to the longitudinal axis.

A first stabilisation section, which remains on the hollow wheel, can also serve for the shape stabilisation of the tubular section on application, for example on the one hand (i) under a load, such as for example given a loading by way of at least one planet wheel that runs in the hollow wheel and/or on the other hand (ii) for stabilisation with regard to centripetal forces given a rapid rotation of the hollow wheel.

In some embodiments, the first stabilisation section forms a stabilisation collar.

In some embodiments, the first stabilisation section forms a stabilisation rib.

In some embodiments, the first stabilisation section is directed towards the longitudinal axis. It can be directed inwards from the tubular section. The extension of the hollow wheel in the longitudinal direction can therefore be kept small. Furthermore, this can simplify the removal of the tubular section from the die after creating the toothings.

On the other hand, in some embodiments, the first stabilisation section can be directed away from the longitudinal axis. It can be directed outwards from the tubular section. A relatively good shape stabilisation can therefore be achieved even given a somewhat small radial extension of the first stabilisation section. And the first stabilisation section can be designed such that the access to the inside of the hollow wheel is not inhibited by it.

The first stabilisation section (or the collar) can be designed in a peripheral, in particular completely peripheral manner. It can be completely peripheral around the periphery of the tubular section.

Furthermore, the first stabilisation unit (or the collar) can be rotationally symmetrical about the longitudinal axis. In this manner, all radial directions are stabilised to the same extent.

In some embodiments, the first stabilisation section forms a peripheral end-face of the hollow wheel that is angled with respect to the tubular section. The end-face can lie, for example, in a plane, on which the longitudinal axis is perpendicular. A particularly good shape stabilisation can therefore be achieved relative to the quantity of material that is used for the first stabilisation section.

In some embodiments, the workpiece in the first stabilisation section is widened or narrowed relative to the tubular section or is directed inwards or outwards by at least 90°.

The workpiece including the first (and possibly also a second) stabilisation section can be obtained from a tubular base body, for example, by way of reshaping, for example by cold reshaping.

For example, the workpiece in the first stabilisation section can be widened with respect to the tubular section, and in particular can have a diameter that enlarges with an increasing distance to the tubular section; or it can taper, and in particular have a diameter that becomes smaller with an increasing distance to the tubular section.

For example, the first stabilisation section can describe a rotationally symmetrical truncated cone shell shape. In particular, the first stabilisation section can be designed such that in one cross section, in particular in every cross section perpendicular to the longitudinal axis, it describes a straight line that is aligned at an angle to the longitudinal axis.

In contrast, in some embodiments, the first stabilisation section describes an annulus shape. A spatial requirement of the first stabilisation section in the axial direction can be kept very small in this manner. The first stabilisation section can be extended essentially at right angles to the longitudinal axis.

The described annulus can have an inner diameter that corresponds essentially to the outer diameter of the tubular section. In other embodiments, the annulus can have an outer diameter that corresponds essentially to the inner diameter of the tubular section.

In some embodiments, the first stabilisation section is directly connected to a first end of the tubular section. In other embodiments, the first stabilisation section is connected to a first end of the tubular section in an indirect manner, specifically via a transition region.

In an embodiment, the first stabilisation section (or the respective collar) has a minimal distance to the longitudinal axis, which is smaller, in particular which is at least 0.25 times (for example at least 0.4 times) a toothing depth of the internal toothing smaller than a minimal distance that the tubular section has to the longitudinal axis (before producing the toothings). For example, the first stabilisation section (or the respective collar) can be rotationally symmetrical about the longitudinal axis, just as the tubular section and its inner diameter is smaller than the inner diameter of the tubular section (before producing the toothings), for example by at least 0.5 times (in particular by at least 0.8 times) a toothing depth of the internal toothing. A suitable shape stability can be realised by way of this.

And/or the first stabilisation section (or the respective collar) has a minimal distance to the longitudinal axis that is smaller, in particular at least 0.2 times (for example at least 0.4 times) a toothing depth of the internal toothing smaller than a minimum distance which a tooth tip of the internal toothing has to the longitudinal axis. For example, the first stabilisation section (or the respective collar) can be rotationally symmetrical about the longitudinal axis and its inner diameter is smaller than the tip diameter of the internal toothing, for example at least 0.3 times or 0.4 times (in particular by at least 0.8 times) a toothing depth of the internal toothing smaller than the tip diameter of the internal toothing. A suitable shape-stability can be realised by way of this.

In an embodiment, the first stabilisation section (or the respective collar) has a maximal distance to the longitudinal axis that is larger, in particular which is at least 0.25 times (for example at least 0.4 times) a toothing depth of the internal toothing larger than a maximal distance that the tubular section has to the longitudinal axis (before production of the toothings). For example, the first stabilisation unit (or the respective collar) can be rotationally symmetrical about the longitudinal axis just as the tubular section and outer diameter is larger than the outer diameter of the tubular section (before production of the toothings) for example by at least 0.5 times (in particular by at least 0.8 times) a toothing depth of the internal toothing. A suitable shape-stability can be realised by this.

And/or the first stabilisation section (or the respective collar) has a maximal distance to the longitudinal axis which is larger, in particular, which is at least 0.2 times (for example at least 0.4 times) a toothing depth of the internal toothing larger than a maximal distance that a tooth tip of the internal toothing has to the longitudinal axis. For example, the first stabilisation section (or the respective collar) can be rotationally symmetrical about the longitudinal axis, and its outer diameter is larger than the tip diameter of the internal toothing, for example at least 0.3 times or 0.4 times (in particular, at least 0.8 times) a toothing depth of the internal toothing larger than the tip diameter of the external toothing. A suitable shape stability can be realised by way of this.

The precise dimensioning of the first stabilisation section depends on many details, for example on material characteristics of the tubular section and on its material thickness.

In some embodiments, the first stabilisation section forms a base part of the workpiece. The tubular section can be designed together with the base part in a pot-shaped manner, wherein the tubular section forms a pot wall and the base part a pot base. The base part can include an opening, in particular a central opening.

The workpiece can yet include a second stabilisation section additionally to the first stabilisation section. The characteristics and functions of the second stabilisation section can be the same as have been described for the first stabilisation section. This being with the exception that it is generally not envisaged for both stabilisation sections to be connecting to the same end of the tubular section. In contrast, one can envisage for example the first stabilisation section connecting onto a first end of the tubular section (be it directly or via a first transition region) and the second stabilisation section connecting onto a second end of the tubular section (be it directly or via a second transition region).

For example, the two stabilisation sections can each be provided connecting to one of the opposite ends of the tubular section (directly or indirectly). One can therefore envisage at least a part of the internal toothing and at least a part of the external toothing being arranged between the first and the second stabilisation section with respect to their axial position.

If two stabilisation sections are provided, one can envisage at least one of these, for example the first stabilisation section (or the respective collar) being directed towards the longitudinal axis. And/or this first stabilisation section (or the respective collar) includes the dimensions specified further above concerning its minimal distance to the longitudinal axis or concerning its inner diameter. A removal of the tubular section from the die after machining by way of the at least one stamping tool can be simplified by way of this.

In the case of two stabilisation sections, therefore, for example:

- both stabilisation sections can be directed inwards; or
- one of the stabilisation sections directed inwards and a further one directed outwards.

In some embodiments, the workpiece (or the hollow wheel) includes a second stabilisation section, wherein the second stabilisation section is directed towards the longitudinal axis, and wherein a minimal distance the second stabilisation section has to the longitudinal axis is smaller than a minimal distance which a tooth tip of the internal toothing has to the longitudinal axis. Those dimensions for the first stabilisation section, which have been specified further above, are referred to with regard to possible dimensioning.

In an embodiment, the tubular section and the first stabilisation section have the same material thickness before the machining by way of the stamping tool. Corresponding workpieces or blanks are quite inexpensive and simple to manufacture.

In some embodiments, the internal toothing is designed as a full-depth toothing, with a toothing depth of more than 2.0 times a normal module of the internal toothing, for example with a toothing depth of more than 2.2 times a normal module of the internal toothing. In particular, the internal toothing can have with a toothing depth of at least 2.4 times a normal module of the internal toothing. Large toothing depths permit a large degree of overlap, which renders the respective hollow wheels particularly loadable.

A toothing depth that corresponds to 2.2 times a normal module of a gear toothing corresponds to the common value for gear involute toothings.

In some embodiments, the internal toothing has a module between 0.5 and 5, in particular between 1 and 3 and/or a module of at least 1.25.

In some embodiment, the internal toothing has a pitch diameter and a toothed length, concerning which the pitch diameter is at least 2 times and at the most 20 times as large, in particular at least 3 times and at the most 15 times as large or at least 4 times or at the most 10 times as large as the toothed length.

As is known, for the transverse module ms: ms=Td/p, wherein Td designates the pitch diameter and p the number of teeth of the toothing. And for the transverse module ms: ms=t/π, wherein π is Pi and t the pitch (transverse pitch) of the toothing. The normal module $m_N$ results as $m_N=m_S \cos \beta$, wherein β is the helix angle of a helical toothing; for spur toothings β=0°.

The internal toothing and the external toothing can be spur toothings.

However, in some embodiments the internal toothing and the external toothing are helical toothings. Herein, for the helix angle it can be: $40° \geq |\beta| \geq 5°$.

In further embodiments, the internal toothing and the external toothing are herringbone toothings.

The internal toothing can be an involute toothing. However, other gear toothings are also manufacturable. For example, the internal toothing can be a cycloidal toothing.

In some embodiments, a toothing depth of the external toothing is smaller than a toothing depth of the die toothing. A corresponding dimensioning of the die (or of the tooth gaps of the die toothing) can simplify the manufacture of the hollow wheel and in particular the reshaping.

In some embodiments, a toothing depth of the external toothing is smaller than a toothing depth of the internal toothing. A corresponding dimensioning of the stamping tool (or of its active region) and of the die (or of the tooth gaps of the die toothing) can simplify the manufacture of the hollow wheel and in particular the reshaping.

The die can be manufactured of a metal. It can be a unitary part.

Most features that relate to the workpiece can be conferred upon the (finished) hollow wheel. Even if some of the characteristics of the workpiece or of the hollow wheel, such as, for example, the characteristics of the first stabilisation region at least appear to be described in a special context, such as, for example, in the context of the manufacturing method, these can basically likewise be characteristics of the finished hollow wheel. In order to keep the text minimal, most of these characteristics are therefore not once again repeated as features explicitly referring to the finished hollow wheel.

The hollow wheel includes:

a tubular section with a longitudinal axis, which includes an internal toothing and an external toothing, wherein the internal toothing is a gear toothing;

a first stabilisation section.

The first stabilisation section can be toothing-free. And it can form a unitary part together with the tubular section. It can form a collar of the hollow wheel. Herein, the collar can be directed in particular to the longitudinal axis or away from the longitudinal axis. The collar can be directly adjacent to the tubular section or be adjacent to a transition region, which, for its part, is directly adjacent to the tubular section. The tubular section can basically be cylinder-tube-shaped. The first stabilisation section can be rotationally symmetrical with respect to the longitudinal axis.

A relative thin-walling of the hollow wheel can be defined in that a difference of the root diameter of the external toothing and the tip diameter of the internal toothing is less than twice, in particular less than 1.5 times, a toothing depth of the internal toothing.

Furthermore, one can envisage a difference of the root diameter of the external toothing and the tip diameter of the internal toothing being more than 0.2 times, in particular more than 0.3 times, a toothing depth of the internal toothing.

If a hollow wheel is manufactured in the described manner, characteristic shapes can arise, the existence and fashioning of which amongst other things can depend on how the first stabilisation section is arranged relative to the internal toothing and the external toothing. However, their recognition on the finished product of the hollow wheel can also permit the recognition that this hollow wheel has been manufactured in the described manner—except for if the characteristic shapes have been subsequently removed.

In an embodiment of the hollow wheel, the collar is directed away from the longitudinal axis, and an internal residual toothing adjoining the internal toothing is formed in a transition region between the tubular section and the first stabilisation section. And furthermore a tip diameter of the internal residual toothing is smaller than a tip diameter of the internal toothing;

and/or an axially projecting bead is formed on each tooth root of the internal residual toothing.

If the engagement of the at least one stamping tool extends up to where, with respect to its axial position, the first stabilisation section begins, then a radially outwardly directed material flow there is rendered quite difficult by way of the first stabilisation section. Accordingly, the material must seek different paths on cold reshaping. In the described arrangement, on the one hand this means material flows radially inwards (on both sides of the active region of the stamping tool), so that a reduced size of tip diameter of the internal residual toothing occurs. And on the other hand, the material also flows roughly in the axial direction, which points away from the tubular section, so that the beads form.

In another embodiment of the hollow wheel, an external residual toothing, which connects onto the external toothing, is formed in a transition region between the tubular section and the first stabilisation section, wherein in the transition region, a toothing depth of the external residual toothing continuously reduces to zero from a toothing depth of the external toothing. In particular, teeth of the external residual toothings can have a rounded shoulder in the transition region, in particle in a section of the transition region that is adjacent to the tubular section. Herein, the collar of the first stabilisation section can be directed towards the longitudinal axis; however, the first stabilisation section can also be designed differently and include for example an outwardly directed collar.

One can envisage a section of the transition region being able to be designed in a tubular, in particular in a cylinder-tubular manner. For example, a section of the transition region that is adjacent to the tubular section can be designed in a tubular, in particular in a cylinder-tubular manner.

The transition region can be designed (as a whole) in a tubular manner.

In order to quantitatively describe the continuous reduction more precisely, one can say that in a section through a tooth of the external toothing, the section containing the longitudinal axis, an angle that describes the reduction is smaller than 80°, in particular smaller than 70° And furthermore this angle can be greater than 5°, in particular greater than 10°. The angle can be defined, for example, in that in the section one determines a first point, at which the tooth (in the region of the residual toothing) still has 90%° of the height that it has in the tubular section and a second point, at which the tooth (in the region of the residual toothing) still has 10%° of the height that it has in the tubular section, and the angle that a straight line that connects these two points encloses with the longitudinal axis is the angle.

Of course, a workpiece can include:

an internal residual toothing (with the bead or said tip diameter ratios) in a transition region between the tubular section and a collar of a stabilisation section, which is directed away from the longitudinal axis as well as an external residual toothing (with a rounded shoulder) in another transition region between the tubular section and another stabilisation section (with a rounded shoulder).

The diameter (pitch diameter) of the internal toothing typically lies in the range of 50 mm to 500 mm, in particular in the range of 100 mm to 400 mm, and often in the range of 150 mm to 350 mm.

A hollow wheel component is yet described. This includes a hollow wheel of the described type as well as additionally, a body. This body is rotationally fixed with respect to the hollow wheel by way of including an inner profiling that matches the external toothing.

The external toothing can therefore, for example, serve for a rotational fixed receiving of the hollow wheel.

The rotational fixation relates to a rotation about the longitudinal axis.

For example, the body can be positively connected to the external toothing. For example, the body can be moulded onto the external toothing A step on manufacturing the body can therefore be that the external toothing is moulded in, by which means at least a part of the body is formed.

In some embodiments, the hollow wheel is a gear hollow wheel.

The hollow wheel can be applied in planetary gears.

The planetary gear includes a hollow wheel of the described type as well as at least one externally toothed gearwheel, which is inserted into the hollow wheel. This gearwheel is toothed in a suitable manner for interacting with the hollow wheel.

Typically, a sun wheel and at least two planet wheels are inserted into the hollow wheel.

Accordingly, the method for manufacturing a planetary gear includes the manufacture of a hollow wheel in the described way and manner, and it further includes the provision of at least one externally toothed gearwheel and the insertion of this into the hollow wheel.

The gearwheel includes an external toothing that matches the internal toothing of the hollow wheel. Typically, a sun wheel and at least two planet wheels are introduced into the hollow wheel.

The invention furthermore also relates to an apparatus that is suitable for carrying out the manufacturing method or an apparatus with the follow characteristics.

A method for manufacturing hollow wheels that include an internal toothing and an external toothing, wherein the internal toothing is a gear toothing, and the apparatus includes:

a die, which, for receiving a tubular section of a workpiece, includes a tubular opening, in which an internal die toothing is formed;

a die holder, which is rotatable about a longitudinal axis, for holding the die in a manner such that a tubular section of a workpiece, which is received in the die, is machinable at its inner side;

a rotation drive for the rotation of the die holder, the drive being designed for producing a rotation with a temporally varying rotation speed, in particular for producing an intermittent rotation;

a tool holder for holding at least one stamping tool, the tool holder being drivable into a an oscillating movement that runs perpendicularly to the longitudinal axis, so that the tubular section at its inner side is repeatedly, in particular periodically, machinable by the at least one stamping tool;

a synchronisation device for the synchronisation of the rotation of the die holder that is producible by way of the rotation drive, with the oscillating movement of the tool holder, which runs perpendicularly to the longitudinal axis.

Many further details of the apparatus result directly from the method, which is described above. These are therefore not repeated here.

In an embodiment, the apparatus includes a loading device for inserting a tubular section of a workpiece that is to be received in the die, into the tubular opening of the die. The loading device includes a further drive for a relative movement of the workpiece and die, said relative movement running parallel to the longitudinal axis. The insertion of the tubular section into the tubular opening of the die can therefore be automated.

Furthermore, it can be relevant to ensure that a relative position of the workpiece and die is (axially and/or radially) fixed, at least at the beginning of the cold-reshaping machining.

Accordingly, the apparatus can include a holding device for fixing a position of a workpiece that is received in the die, relative to the die during said rotation of the die holder. For example, a pressing pressure can be produced by way of the holding device, by way of which pressure the workpiece and the die are pressed towards one another in the axial directions. The workpiece and the die thus execute the same rotation movement.

The pressing device can be co-rotated with the rotation of the die holder.

The fixation can be effected, for example, by way of subjecting a stabilisation section of the workpiece to pressure.

For example, an axial pressing of the workpiece onto the die or of the die onto the workpiece can take place.

The holding device can be provided additionally to the drive. However, it is also possible for at least a part of the holding device to be identical to at least a part of the further drive.

The described apparatus can be used for simultaneously creating an internal toothing and an external toothing in a tubular section of a workpiece, wherein the internal toothing is a gear toothing.

Further details of the use of the apparatus result from the above description of the manufacturing method, of the hollow wheel and of the apparatus.

BRIEF DESCRIPTION OF THE DRAWINGS

The subject-matter of the invention is hereinafter explained in more detail by way of embodiment examples and the attached drawings. There are shown schematically in.

DETAILED DESCRIPTION OF THE INVENTION

Parts that are not essential for the understanding of the invention are to some extent not represented. The described embodiment examples are exemplary for the subject matter of the invention or serve for its explanation and have no limiting effect. Most of the following embodiments, for the sake of simplicity, implicitly or explicitly relate to spur toothings but can also be conferred upon other toothing types.

Figure 1:
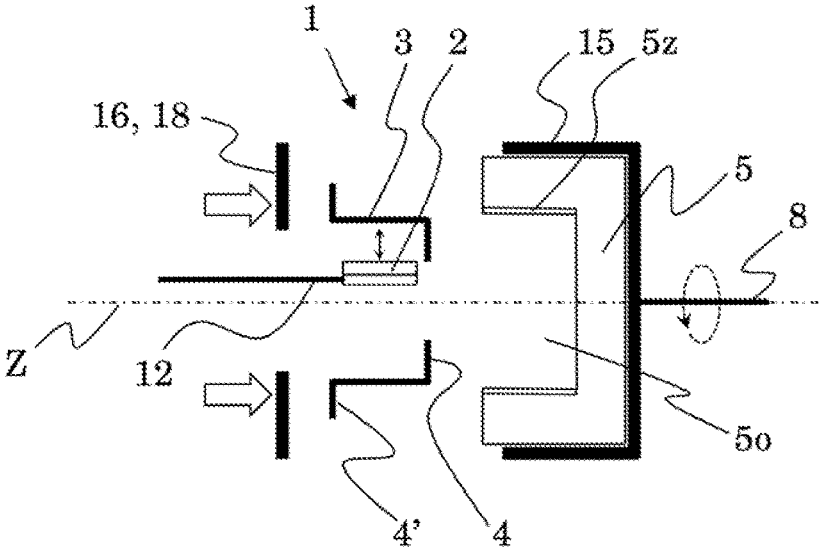
FIG. 1 shows details of an apparatus for manufacturing hollow wheels, in a section that runs through the longitudinal axis.

FIG. 1 shows details of an apparatus for manufacturing hollow wheels, in a greatly schematised sectioned representation. A workpiece 1 is thin-walled and can be provided with an internal toothing and an external toothing by way of the apparatus, wherein the internal toothing is a gear toothing, for example an involute toothing.

The workpiece 1 has a longitudinal axis Z and a tubular section 3, which is cylindrical and is aligned coaxially to the longitudinal axis Z and into which the two mentioned toothings are incorporated by way of a stamping tool 2.

The section, which is represented in FIG. 1, runs through the longitudinal axis Z.

The apparatus further includes a die 5, which includes an internal die toothing 5*z* as well as a tubular opening 5*o* for receiving the workpiece 1. The die 5 is held in a die holder 15, which is driveable into rotation about a rotation axis, for example, by way of a driven headstock 8

The stamping tool 2, by way of which a workpiece 1 can be periodically machined, is held by way of a tool holder 12. For this, the tool holder 12 executes an oscillating movement in the radial direction (illustrated by a small double arrow in FIG. 2). Directions that run perpendicular to the longitudinal axis Z are indicated as radial.

The workpiece 1 is inserted into the tubular opening 5*o* of the die 5 in the axial direction, as is symbolised by the open arrows, by way of the loading device 16. The tool 1 is then held in a fixed position relative to the die 5 by way of a holding device 18, which can be partly identical to the loading device 16, typically before and during the workpiece and die rotation, for example by way of pressing the two parts against one another in the axial direction.

The die 5 (and in particular its die toothing 5*z*), the workpiece 1 (and in particular its tubular section 3 and its longitudinal axis Z) and the rotation axis of the die holder 15 are aligned coaxially to one another during the machining of the workpiece 1 by the stamping tool 2. And the workpiece 1 co-rotates with the die holder 15, for example by way of the holding device 18 being rotatably mounted.

Since therefore the longitudinal axis Z of the workpiece 1 coincides with the rotation axis of the rotatable die holder 15 during the machining, for the sake of simplicity the respective axes are hereinafter both indicated as the longitudinal axis Z or as the axis Z.

The die holder 15 does not need to be directly drivable for its rotation. For example, the holding device 18 can also be driven (for example directly) for rotation, and the die holder 15 is rotatably mounted and co-rotates, including the die 5 and the workpiece 1, with the holding device 18.

The rotation takes place with a temporally varying rotation speed, synchronised with the radially oscillating movement of the stamping tool 2.

The tool holder 12, as illustrated, can include a shank, which is driven into an oscillating movement, for producing the radially oscillating movement of the stamping tool 2. In this manner, the stamping tool 2 repeatedly, generally periodically engages with the workpiece. The workpiece 1 for its part is rotated about the axis Z with a varying rotation speed, in particular intermittently rotated (illustrated by the dashed circular arrow in FIG. 1). The oscillating movement of the tool holder 12, which corresponds to an oscillating movement of the stamping tool 2, is synchronised with the rotation of the workpiece 1 such that the stamping tool 2 engages with the workpiece 1 in phases of minimal workpiece rotation speed (in the case of an intermittent workpiece rotation: in phases of the standstill of the intermittent rotation of the workpiece). In the case of an intermittent workpiece rotation, the workpiece 1 can be rotated further (typically by one pitch) as soon as the tool holder 12 is displaced far enough (in the radial direction) such that no stamping tool comes into contact with the workpiece 1 during the workpiece rotation. The speed profile (temporal variation of the rotation speed) is to be selected accordingly given a non intermittent workpiece rotation.

Thereafter—thus in the case of intermittent rotation within the next standstill phase—the stamping tool 2 engages into the workpiece 1 again, for the further formation of the next tooth gap of the toothing to be produced, etc. The toothings are therefore produced in a cold reshaping manner by way of successively carrying out a number of stamping steps.

The forces, which act upon the thin-walled workpiece 1 by way of the stamping tool 2 with the stamping reshaping, are so large that undesirable deformations of the tubular section 3 can occur without further precautions. Instead of retaining its basic circular cross section, an oval or elliptical cross section of the tubular section 3 can form and lead to an insufficient accuracy of the toothings, which is very undesirable. An undesirable conicity of the tubular section 3 can also form, so that its diameter would be increasing in a direction along the longitudinal axis.

For this reason, the workpiece (during its machining) includes at least one stabilisation section. In the example of FIG. 1, the workpiece 1 has an inwardly (to the longitudinal axis) directed stabilisation section 4 and an outwardly (away from the longitudinal axis) directed stabilisation section 4' which both each connect to an end of the tubular section 3. The stabilisation sections 4, 4' form collars of the workpiece 1 and are integrally formed (and thus form a unitary part) with the tubular section 3.

Due to their extension in the radial direction, the stabilisation sections 4, 4' effect a shape stabilisation, so that said deformations can be prevented or at least reduced to an acceptable amount.

The thin-walled workpiece 1 is formed into the die toothing 5*z* of the die 5 by way of the stamping tool in the described manner, for the simultaneous creation of the internal and external toothing in the tubular section 3. This is illustrated by way of FIGS. 2*a*, 2*b*.

Figure 2A:
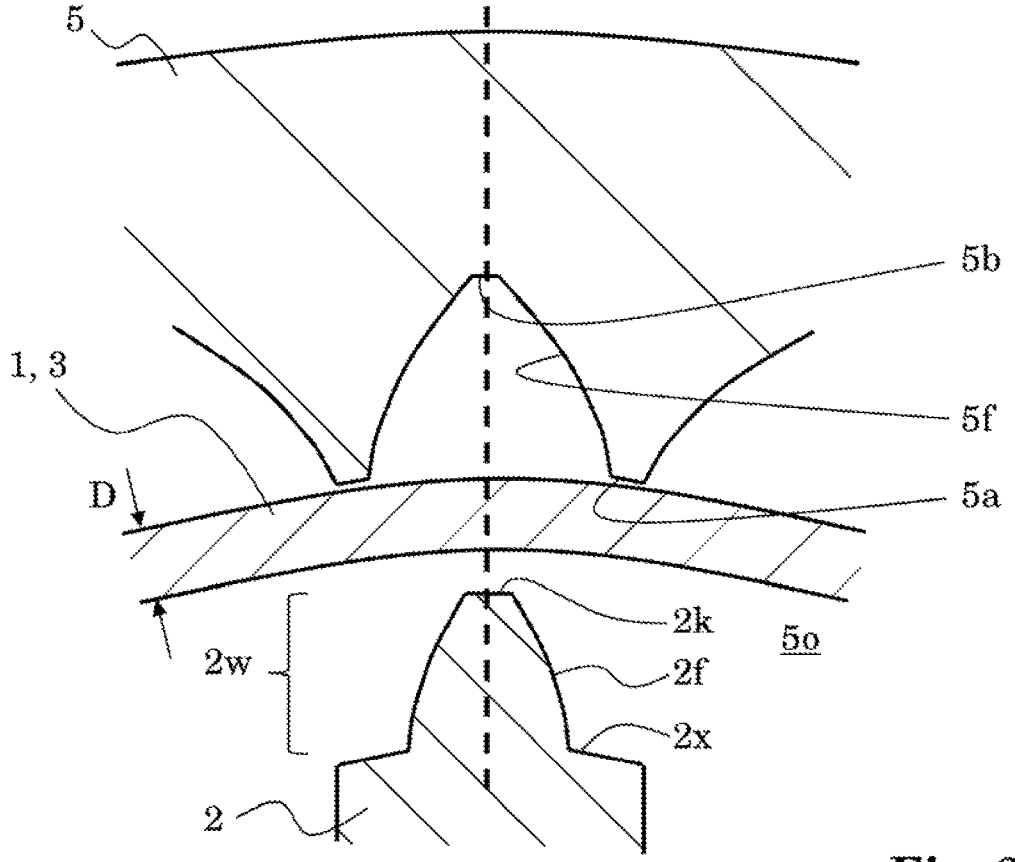
FIG. 2*a* is an illustration of the method before a first stamping tool engagement into the workpiece, in a section perpendicular to the longitudinal axis.
Figure 2B:
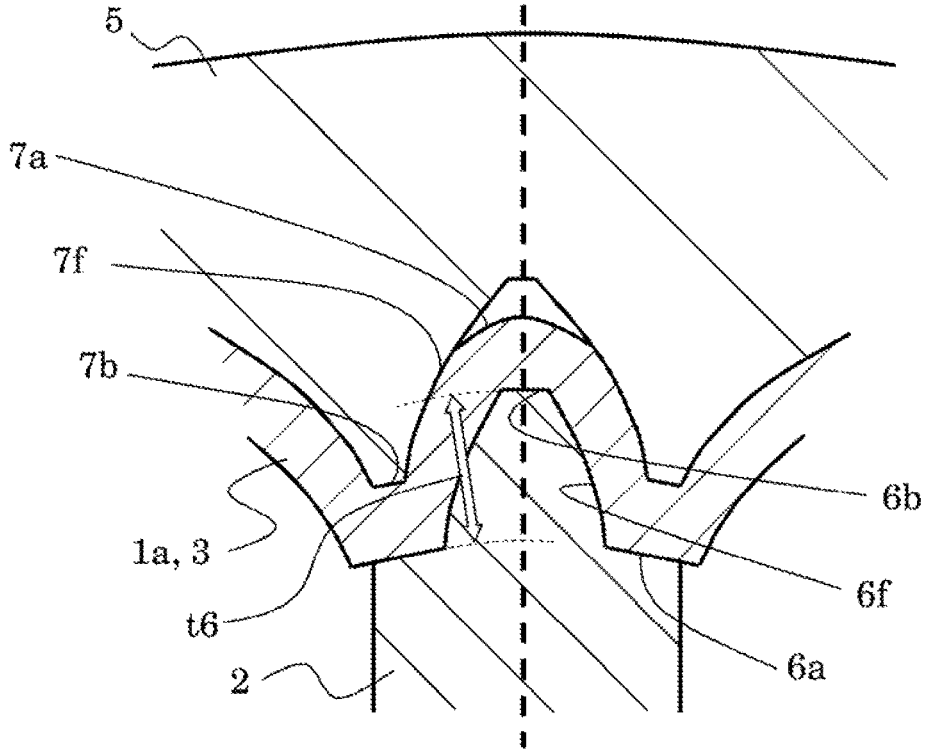
FIG. 2*b* is an illustration of the method during a stamping tool engagement on manufacturing a hollow wheel, in a section perpendicular to the longitudinal axis.

FIG. 2*a* is a schematic illustration of the method before a first stamping tool engagement into the workpiece 1, in a section perpendicular to the longitudinal axis; and FIG. 2*b* is a schematic illustration of the method during a stamping tool engagement on completing the hollow wheel 1*a*, in the same step.

The still untoothed workpiece 1 is located in the opening 5*o* of the die 5 before the first stamping tool engagement (FIG. 2*a*). A tooth tip 5*a*, a tooth root 5*b* and a tooth flank 5*f* of the internal die toothing are characterised in FIG. 2*a*. Many hammering engagements of the stamping tool 2 are carried out at each of the peripheral positions, at which the tooth gaps of the die toothing are provided, and the internal toothing and external toothing are completed after this. FIG. 2*b* shows the workpiece which is now a toothed hollow wheel 1*a*, during a last reshaping engagement of the stamping tool 2.

The thickly dashed line in FIGS. 2*a*, 2*b* characterises a radial direction, along which the periodic linear movement of the stamping tool 2 for reshaping the workpiece runs.

The thin dashed lines in FIG. 2*b* characterise the root diameter or the tip diameter of the internal toothing. The open arrow in FIG. 2*b* characterises the toothing depth t6 of the internal toothing. In the embodiment example of FIGS. 2*a*, 2*b*, the material thickness D of the untoothed tubular section 3 (FIG. 2*a*) is about 0.4 times the toothing depth t6 of the internal toothing.

The stamping tool 2 includes an active region 2*w*, which includes a tool head 2*k* and two tool flanks 2*f* The active region 2*w* has a shape that is a negative of a shape of a tooth gap of the internal toothing that is to be produced (FIG. 2*b*). Furthermore, the stamping tool 2 includes two calibrating regions 2*x*, by way of which the tooth tips 6*a* (FIG. 2*b*) of the internal toothing are shaped, for example, one can envisage the shape of a section of a calibrating region 2*x* being a negative of the shape of a section of a tooth tip 6*a* of the internal toothing.

The tool flanks 2*f* have the shape of a negative of a flank 6*f* of the internal toothing 2, and the tool head 2*k* has the shape of a negative of a tooth root 6*b* of the internal toothing (FIG. 2*b*).

Whereas the shape of the internal toothing is essentially defined by the shape of the stamping tool 2, the shape of the external toothing is defined essentially by the shape of the die toothing.

The shape of a tooth tip 5*a* of the die toothing corresponds to a negative of the shape of a tooth root 7*b* of the external toothing that is to be produced. And the shape of the tooth flanks 5*f* of the die toothing corresponds to a negative of the shape of tooth flanks 7*f* of the external toothing. However, the shape of the tooth tip 7*a* of the external toothing is determined by free material flow. A distance remains between the tooth tips 7*a* of the external toothing and the respective tooth roots 5*b* of the die toothing. Of the tooth flanks 5*f* of the die toothing, it is only a section that comes into contact with the workpiece and thus determines the shape of the flanks 7*f* of the external toothing.

A hammering forming of the first untoothed tubular section 3 into the die toothing takes place at those locations which are distributed over the periphery of the tubular section 3, at which tooth gaps of the die toothing are located, thus where the teeth of the external toothing and tooth gaps of the internal toothing come to lie (arise). For example, the workpiece 1 can be machined once in each tooth gap of the die toothing 5*z* by the stamping tool 2 (thus receive precisely one radially hammering impact and be reshaped by way of this), before it is machined a further time at one of the tooth gaps of the die toothing 5*z*.

A production of the internal toothing takes place with a simultaneous production of external toothing.

The number of teeth and the number of tooth gaps is identical for the internal toothing and for the external toothing and for the die toothing. And the tooth roots 6*b* of the internal toothing are located at the same positions along the periphery of the tubular section as the tooth tips 7*a* of the external toothing. And accordingly the tooth tips 6*a* of the internal toothing are located at the same positions along the periphery of the tubular section 3 as the tooth roots 7*b* of the external toothing.

It is also possible to apply a second stamping tool. This, at least with regard to its active region and calibrating region, can have the same shape as the other stamping tool.

The stamping tool is distanced radially from the workpiece again each between the individual hammering machining steps.

In the method that is described here, no rolling of the stamping tool on the workpiece takes place, which is in contrast to some methods for profiling workpieces, termed as rolling-off. And the tool is also not permanently in contact with the workpiece but always only briefly with a subsequent phase in which no contact and no reshaping takes place. And the tool does not have a multitude of teeth that are distributed over its periphery, but, as represented, only a tooth-like active region or at the most two (not represented).

Figure 3A:
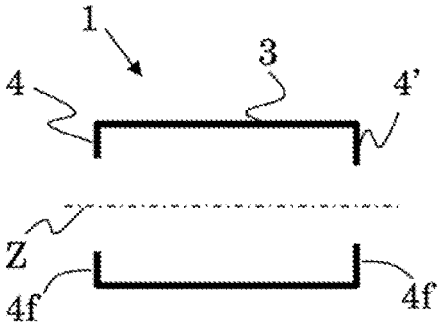
FIG. 3*a* shows workpiece with two stabilisation sections, which are directed towards the longitudinal axis, in a section which runs through the longitudinal axis.

FIG. 3*a* shows a workpiece 1 with two stabilisation sections 4, 4', which are directed towards the longitudinal axis Z, in a section that runs through the longitudinal axis Z. The stabilisation sections 4, 4' each form a collar, which is also the case with the further embodiments. The characteristics that are described hereinafter can also be attributed to the respective collar.

Figure 3C:
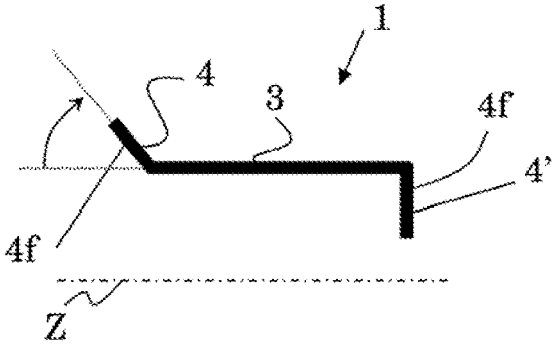
FIG. 3*c* shows a detail of a workpiece with a stabilisation section which is directed towards the longitudinal axis and with a stabilisation section which is directed away from the longitudinal axis, in a section that runs through the longitudinal axis.
Figure 3B:
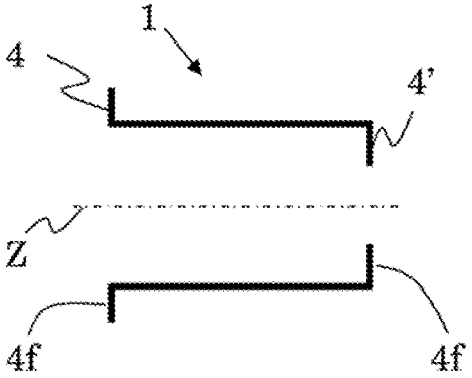
FIG. 3*b* shows a workpiece with a stabilisation section, which is directed towards the longitudinal axis, and a stabilisation section, which is directed away from the longitudinal axis, in a section that runs through the longitudinal axis.

FIG. 3*b* shows a workpiece 1 with a stabilisation section 4', which is directed towards the longitudinal axis and a stabilisation section 4, which is directed away from the longitudinal axis, in a section that runs through the longitudinal axis Z.

The stabilisation sections, which are shown in FIGS. 3*a*, 3*b*, each form annulus-shaped end-faces 4*f* of the workpiece 1. An opening angle of the end-faces 4*f*, however, does not need to be 90° as in FIGS. 1 and 3*a* and 3*b*. However, a high shape stability with very small extensions along the longitudinal axis Z can be achieved at 90°.

FIG. 3*c* shows a detail of a further rotationally symmetrical workpiece 1 with a stabilisation section 4' that is directed towards the longitudinal axis Z and, with a stabilisation section 4 that is directed away from the longitudinal axis Z, in a section that runs through the longitudinal axis, wherein the stabilisation section 4 has an opening angle of about 45°. There, the diameter of the workpiece 1 enlarges with an increasing distance to the tubular section 3. The end-face 4*f*, which forms the stabilisation section 4, is a rotational symmetrical truncated cone shape.

Figure 3D:
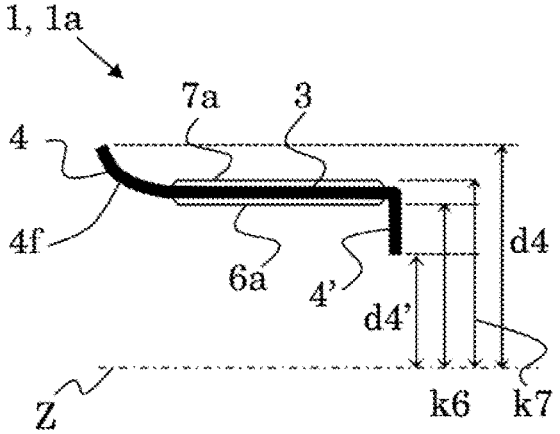
FIG. 3*d* shows a detail of a hollow wheel with a stabilisation section which is directed towards the longitudinal axis and with a stabilisation section, which is directed away from the longitudinal axis, in a section that runs through the longitudinal axis.

However, a stabilisation section does not need to display a straight line in the represented sections, which contain the longitudinal axis Z; other shapes are also possible. FIG. 3*d* shows one example.

FIG. 3*d* shows a detail of a workpiece 1, which is already reshaped into a toothed hollow wheel 1*a*, with a stabilisation section 4', which is directed towards the longitudinal axis Z, and with a stabilisation section 4, which is directed away from the longitudinal axis, in a section that runs through the longitudinal axis Z. The stabilisation section 4 has the shape of a funnel with a bent, conical wall.

In FIG. 3*d*, a tooth tip 7*a* of the external toothing and a tooth tip 6*a* of the internal toothing are indicated in FIG. 3*d* (even if these do not lie precisely in the same section plane), independently of the shape of the stabilisation sections 4, 4'. The toothed length can be recognised; this does not need to extend over the complete length of the tubular section 3.

FIG. 3*d* also illustrates that a maximal distance d4, which a part of the stabilisation section 4, has to the longitudinal axis Z, which with the rotational symmetry that is assumed here corresponds to half the outer diameter of the stabilisation section 4, is greater than half k7 the tip diameter of the external toothing.

FIG. 3*d* also illustrates that a minimal distance d4', which a part of the stabilisation section has to the longitudinal axis Z, which with the rotational symmetry, which is assumed here, corresponds to half the inner diameter of the stabilisation section 4', is smaller than a minimal distance k6, which a tooth tip 6*a* of the internal toothing has to the longitudinal axis Z, thus is smaller than half k6 the tip diameter of the internal toothing.

The typically one or two stabilisation sections are generally untoothed (toothing-free); at least they are free of the internal toothing that is to be produced and free of the external toothing that is to be produced.

Figure 4:
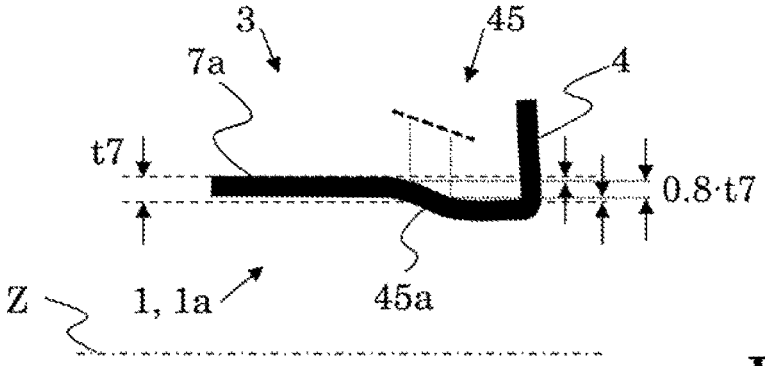
FIG. 4 shows a detail of a hollow wheel for illustrating an external residual toothing in a section that runs through the longitudinal axis.

FIG. 4 shows a detail of a hollow wheel 1*a* for illustrating an external residual toothing 45*a*, in a section through a tooth tip 7*a* of the external toothing, the section running through the longitudinal axis Z. Such an external residual toothing 45*a* forms due to the selected cold-reshaping manufacturing method, due to the free material flow not only in the radial but also in the axial direction within tooth gaps of the die toothing.

In this embodiment example, with regard to which the stabilisation section 4 could otherwise also be directed inwards instead of outwards, there is a transition region 45 between the tubular section 3 and the stabilisation section 4. In the transition region there is an external residual toothing with tooth tips 45, the external residual toothing connecting to the external toothing and in which the toothing depth of the residual toothing slowly decreases, specifically from the toothing depth t7 of the external toothing to zero. An angle of the reduction of the toothing depth can be defined for example as described further above: the points, at which the residual toothing has a toothing depth of 90% of the toothing depth t7 of the external toothing or only yet 10% of the toothing depth t7 of the external toothing, in FIG. 4 are where the dotted lines change directions at right angles. The thickly dashed line with the longitudinal axis Z forms the same angle as a straight line through the two mentioned points, but is not drawn there for the purpose of a better overview. The angle in FIG. 4 is about 20°.

In FIG. 4, independently of this, it is yet represented that the transition region 45 that otherwise describes a region that is extended along the longitudinal axis Z can include an untoothed section and/or a region that is not machined by the stamping tool 2.

Figure 5:
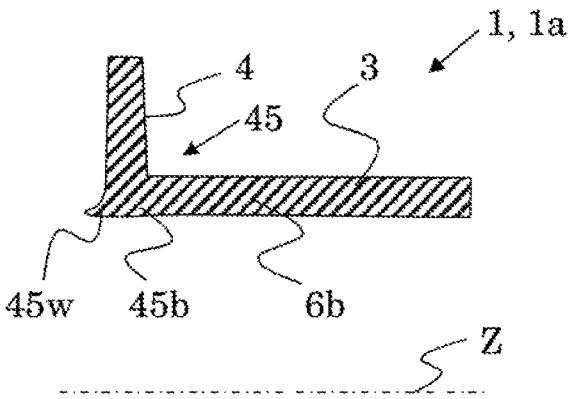
FIG. 5 shows a detail of a hollow wheel with a stabilisation section, which is directed away from the longitudinal axis, for illustrating an internal residual toothing with a bead, in a section through a tooth root of the internal toothing, the section running through the longitudinal axis.
Figure 6:
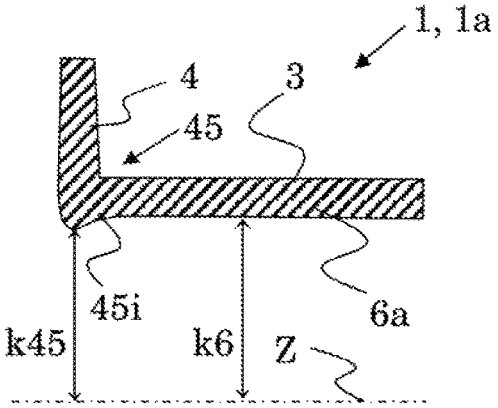
FIG. 6 shows a detail of a hollow wheel with a stabilisation section, which is directed away from the longitudinal axis, for illustrating an internal residual toothing, in a section through a tooth tip of internal toothing, the section running through the longitudinal axis.

As mentioned further above, further structures that are characteristic of the manufacturing method also form in a transition region 45 where an internal residual toothing is produced close to a stabilisation section, for example because of a stamping tool, which is longer than the length of the internal toothing is used for producing the internal and external toothing. FIGS. 5 and 6 show respective examples.

FIG. 5 shows a detail of a workpiece 1, which is already reshaped into the toothed hollow wheel 1*a*, with a stabilisation section 4 which is directed away from the longitudinal axis Z, for illustrating an internal residual toothing with a bead 45, in a section through a tooth root 6*b* of the internal toothing, the section running through the longitudinal axis Z. The section therefore also runs through a tooth root 45*b* of the internal residual toothing. A bead 45*w* forms for each tooth root 6*b* of the internal toothing. This can project axially as is illustrated in FIG. 5.

FIG. 6 shows a detail of a workpiece 1, which has already been reshaped into the toothed hollow wheel 1*a*, with a stabilisation section 4, which is directed away from the longitudinal axis Z for illustrating an internal residual toothing, in a section through a tooth tip 45*i* of the internal toothing, the section running through the longitudinal axis Z. The section therefore also runs through a tooth crown 45*i* of the internal residual toothing. As is evident in FIG. 6, the internal residual toothing has a tip diameter that is smaller than a tip diameter of the internal toothing. In particular, the smallest tip diameter of the residual toothing is smaller than the tip diameter of the internal toothing. Half the minimal tip diameter of the internal toothing is indicated in FIG. 6 as k45, and half the tip diameter of the internal toothing is indicted as k6.

Since the described hollow wheels are thin-walled, these tend to be subjected to elastic deformations under loading. It is therefore appropriate to provide a longitudinal crowning of the internal toothing for a good running behaviour. Edge supports can be avoided in this manner. This can be achieved by way of a suitable design of the stamping tool 2.

FIG. 7 shows a detail of a stamping tool 2, in a section perpendicular to the course of the tool head 2*k*, thus in the same manner as FIGS. 2*a*, 2*b*.

Figure 7A:
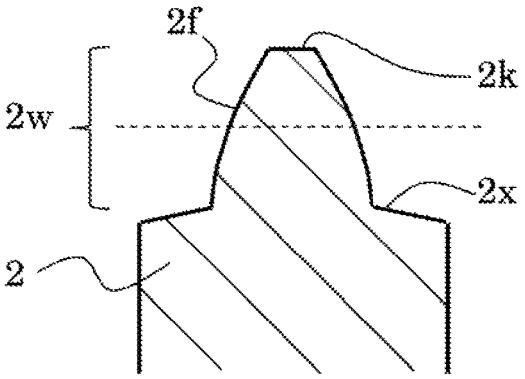
FIG. 7*a* shows a detail of the stamping tool, in a section perpendicular to the course of the tool head.
Figure 7B:
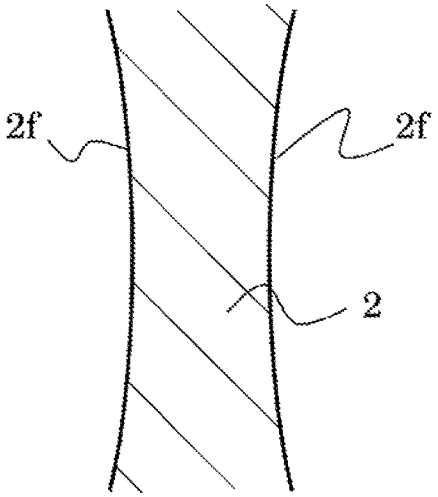
FIG. 7*b* shows a detail of the stamping tool of FIG. 7*a*, in a section parallel to the course of the tool head along the dashed line of FIG. 7*a*, through the tool flanks.

FIG. 7*b* shows a detail of the stamping tool 2 of FIG. 7*a*, but in a section parallel to the course of the tool head 2*k*, along the dashed line of FIG. 7*a*, through the tool flanks 2*f*. A concavity of the stamping tool 2 can be recognised in FIG. 7*b*, by way of which concavity the longitudinal crowning can be produced. This however is represented in an exaggeratedly large manner in FIG. 7*b*. The tool flanks 2*f* are designed for forming the longitudinal crowning of the internal toothing due to their concavity.

Figure 8A:
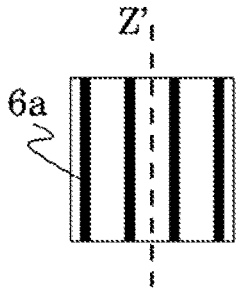
FIG. 8*a* is an illustration of a spur toothing.
Figure 8B:
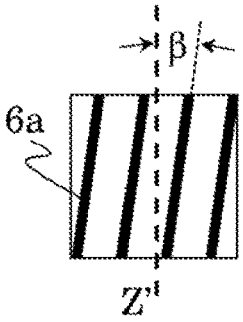
FIG. 8*b* is an illustration of a helical toothing.
Figure 8C:
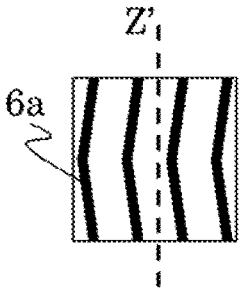
FIG. 8*c* is an illustration of a herringbone toothing.

FIGS. 8*a* to 8*c* illustrate a spur toothing, a helical toothing and a herringbone toothing. All these and yet further toothings can be manufactured by way of the described method. The wide black lines represent the position of the tooth crowns 6*a* of the internal toothing. The drawn dashed line corresponds to an axis Z', which runs parallel to the longitudinal axis Z. The representation can be understood in concept by way of cutting open the hollow wheel and then pressing it with a downwardly pointing external toothing onto a plane (flatly pressed).

In FIG. 8*b*, β indicates the helix angle of the helical toothing.

Figure 9:
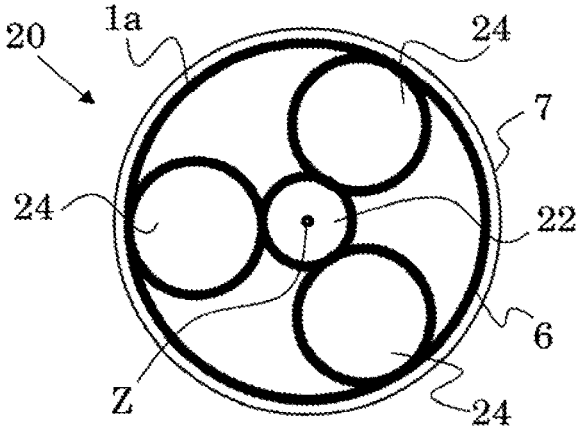
FIG. 9 is an illustration of a planetary gear.

FIG. 9 shows an illustration of a planetary gear 20 with a sun wheel 22, three planet wheels 24 and a hollow wheel 1*a* of the type which is described here. The respective external toothings of the wheels 22, 24, 1*a* are illustrated by the thick lines. The thinly drawn circular line at the outside illustrates the external toothing 7 of the hollow wheel 1*a*. Stabilisation sections are not represented in FIG. 9.

Figure 10:
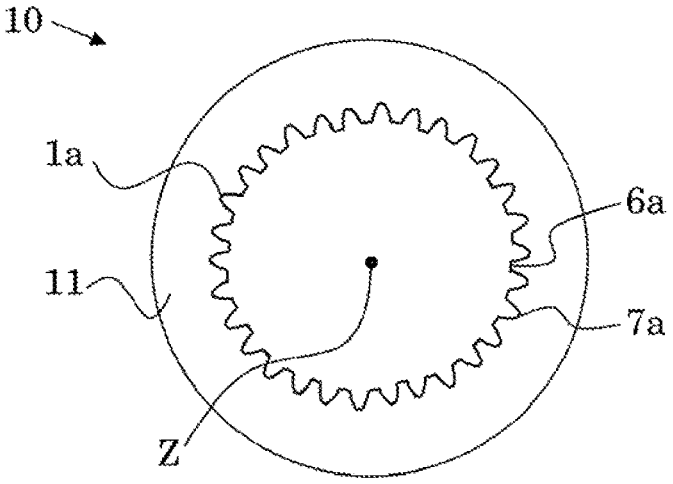
FIG. 10 shows hollow wheel component including a hollow wheel and a body, which is positively connected thereto, in a section perpendicular to the longitudinal axis.

FIG. 10 illustrates a hollow wheel component 10, including hollow wheel 1*a*, which is represented in FIG. 10 in an exaggeratedly thin-walled manner and without a stabilisation section, and a body 11, which is positively connected thereto, in a section perpendicular to the longitudinal axis Z. For example, the body 11 can be of a plastic. The body 11 can be moulded, for example, onto the hollow wheel 1*a*, more precisely: on its external toothing.

New types of hollow wheels, components and gears can be created in the described manner, in particular ones that are suitable for lightweight construction. The respective internal cylinder toothings can be produced economically and with a high precision. The at least one collar, be it directed inwardly or outwardly, permits a shape stability during manufacture, such stability being necessary for high-precision toothings.

The invention claimed is:

1. A method for manufacturing a hollow wheel which comprises an internal toothing and an external toothing, wherein the internal toothing is a gear toothing, the method comprising:

providing a workpiece to be machined with at least one stamping tool, wherein the workpiece comprises a tubular section with a longitudinal axis as well as at least one first stabilization section which is connected to the tubular section for shape stabilization of the tubular section during the machining with the at least one stamping tool, providing a die for receiving the tubular section, the die comprising a tubular opening in which an internal die toothing is provided, inserting the tubular section into the tubular opening, and machining the workpiece on the inner side of the tubular section inserted into the tubular opening with the at least one stamping tool to simultaneously produce the internal toothing and external toothing, wherein during the machining, the workpiece executes a rotation movement with a temporally varying rotation speed about said longitudinal axis and the at least one stamping tool executes radially oscillating movements which are synchronized with said rotation movement so that the at least one stamping tool forms the tubular section into the die toothing to produce the external toothing and to simultaneously produce the internal toothing with repeated hammering machining of the tubular section, wherein the radially oscillating movements are aligned perpendicular to the longitudinal axis.

2. The method according to claim 1, wherein a material thickness of the workpiece in the tubular section is less than twice a toothing depth of the internal toothing, before the insertion of the tubular section into the tubular opening.

3. The method according to claim 1, wherein the at least one stamping tool comprises an active region which comprises a tool head and two tool flanks adjoining the tool head.

4. The method according to claim 3, wherein the tool flanks are shaped such that the internal toothing has a longitudinal crowning.

5. The method according to claim 3, wherein the at least one stamping tool comprises two calibrating regions adjoining one of the two tool flanks each and having a shape which is a negative of a shape of a section of a tooth tip of the internal toothing.

6. The method according to claim 3, wherein the active region has a shape which is a negative of a shape of a tooth gap of the internal toothing.

7. The method according to claim 1, wherein the first stabilization section forms a non-toothed collar of the hollow wheel, said collar forming a unitary part together with the tubular section and being directed towards the longitudinal axis or away from the longitudinal axis.

8. The method according to claim 1, wherein the first stabilization section has a maximal distance to the longitudinal axis which is larger than a maximal distance the tubular section has to the longitudinal axis by at least 0.25 times a toothing depth of the internal toothing;

or the first stabilization section has a minimal distance to the longitudinal axis which is smaller than a minimal distance the tubular section has to the longitudinal axis by at least 0.25 times a toothing depth of the internal toothing.

9. The method according to claim 8, wherein the first stabilization section has an outer diameter which is larger than an outer diameter of the tubular section by at least 0.5 times a toothing depth of the internal toothing;

or the first stabilization section has an inner diameter which is smaller than the inner diameter of the tubular section by at least 0.5 times a toothing depth of the internal toothing.

10. The method according to claim 1, wherein the first stabilization section forms a peripheral end-face of the hollow wheel which is angled with respect to the tubular section.

11. The method according to claim 10, the first stabilization section describes an annular shape or a rotationally symmetrical truncated cone shell shape.

12. The method according to claim 1, wherein the workpiece comprises a second stabilization section and wherein at least one of the two stabilization sections is directed towards the longitudinal axis.

13. The method according to claim 1, wherein the internal toothing is designed as a full-depth toothing with a toothing depth of more than 2.0 times a normal module of the internal toothing.

14. The method according to claim 1, wherein a toothing depth of the external toothing is smaller than a toothing depth of the internal die toothing and is smaller than a toothing depth of the internal toothing.

15. The method according to claim 1, wherein the internal toothing is a spur toothing or a helical toothing or a herringbone toothing.

16. The method according to claim 1, wherein a material thickness of the workpiece in the tubular section is less than 1.5 times a toothing depth of the internal toothing, before the insertion of the tubular section into the tubular opening.

17. The method according to claim 1, wherein the internal toothing is designed as a full-depth toothing with a toothing depth of at least 2.4 times a normal module of the internal toothing.

18. A method for manufacturing a planetary gear, comprising manufacturing the hollow wheel according to the method of claim 1, and further comprising providing at least one externally toothed gearwheel and inserting of the gearwheel into the hollow wheel.

* * * * *